US006222323B1

(12) United States Patent
Yamashita et al.

(10) Patent No.: US 6,222,323 B1
(45) Date of Patent: Apr. 24, 2001

(54) DRIVING METHOD OF A DISPLAY DEVICE EMPLOYING ELECTRO-LIGHT-EMITTING ELEMENTS AND THE SAME DISPLAY DEVICE

(75) Inventors: Akihiro Yamashita, Saga; Hideaki Yamashita, Fukuoka, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/436,466

(22) Filed: Nov. 8, 1999

(30) Foreign Application Priority Data

Nov. 6, 1998 (JP) ..... 10-315878
Jan. 19, 1999 (JP) ..... 11-010134

(51) Int. Cl.[7] ..... G09G 3/10

(52) U.S. Cl. ..... 315/169.3; 315/169.1; 345/44; 345/48; 345/77; 345/84

(58) Field of Search ..... 315/169.3, 167, 315/168, 169.1, 169.2, 149, 163; 345/44, 48, 55, 76, 77, 68, 84, 90; 313/504–506

(56) References Cited

U.S. PATENT DOCUMENTS 4,636,789 * 1/1987 Yamaguchi et al. ..... 340/805
5,757,139 * 5/1998 Forrest et al. ..... 315/169.3
5,903,101 * 5/1999 Kijima ..... 313/506
6,084,579 * 7/2000 Hirano ..... 315/169.3 X
6,114,183 * 9/2000 Hamada et al. ..... 313/504 X

FOREIGN PATENT DOCUMENTS 6-301355 10/1994 (JP) .
9-232074 9/1997 (JP) .

* cited by examiner

*Primary Examiner*—Haissa Philogene
(74) *Attorney, Agent, or Firm*—Ratner & Prestia

(57) ABSTRACT

A driving method of a display device which includes cathodes formed by plural stripe-lines and anodes across the cathodes and formed by plural stripe-lines as well as a light-emitting layer provided between the cathodes and anodes. Firstly, illuminate a first light-emitting element connected to a first cathode, secondly, in order to illuminate a second light-emitting element connected to a second cathode, run electric current into the second element. In this case, remove part of stored charges in the second element and leave charges in at least one light-emitting element other than the second element, then run electric current into the second element. This driving method allows the display device to reduce the power consumption.

14 Claims, 8 Drawing Sheets

DRIVING METHOD OF A DISPLAY DEVICE EMPLOYING ELECTRO-LIGHT-EMITTING ELEMENTS AND THE SAME DISPLAY DEVICE

FIELD OF THE INVENTION

The present invention relates to a display device displaying information by illuminating a plurality of light-emitting elements, more particularly to a driving method of a display device employed in portable terminals and the same display device.

BACKGROUND OF THE INVENTION

In recent years, organic electro-luminescent (EL) elements have been arrayed in a matrix, which has been positively tested as a display panel. A driving method of this display panel employing the organic EL elements is disclosed as "a simple matrix method" in the Japanese Patent Application Unexamined Publication No. H06-301355.

FIG. 10 illustrates a structure and a driving method of a conventional display device.

In FIG. 10, the display device comprises display section 106, anode control circuit 107 and cathode control circuit 108. At each intersection of anodes "a1–am" and cathodes "c1–cn" arrayed in a matrix, light-emitting elements—formed of organic EL elements—"L1,1–Lm,n" are placed. The cathodes are scanned and driven at a given interval, and then the anodes are selectively driven being synchronized with this cathode-driving so that an arbitrary light-emitting element is selectively illuminated. Further, a reverse bias voltage or a voltage not more than a threshold value for illumination is applied to non-selected elements thereby avoiding erroneous lighting thereof (cross talk) due to leak current.

A driving method of the conventional display device is described hereinafter with reference to FIG. 10.

FIG. 10 illustrates a case where "L1,1" and "L2,1" among the light-emitting elements L1,1–Lm,n are selected to be lit. Anode lines "a1" and "a2" are coupled to current sources J1 and J2 by closing switches "Sa1" and "Sa2", and cathode line "c1" is coupled to ground potential (GND) by switch "Sc1", thereby running forward-bias-current to elements L1,1 and L2,1 and lighting these two elements.

Anode lines "a3–an" are coupled to ground potential by switches Sa3–Sam, and cathode lines "c2–cn" are coupled to power supply voltage Vcc by switches Sc2–Scn. Forward-bias-voltage produced both the ends of the two elements L1, 1 and L2,1 is referred to as Vf at lighting the two elements. Then the voltage applied to both the ends of non-lit elements takes either one of two values, i.e. "−Vcc" and "Vf−Vcc". The value of Vcc is set at a value so that the value of "Vf−Vcc" cannot be more than the threshold value of illumination, whereby non-selected elements are prevented from being erroneously lit.

However, this driving method produces two bias voltages at the non-lit elements. The elements having different bias voltages store different amount of charges in each parasitic capacitance of respective elements. Then when these non-lit elements are driven simultaneously, the elements biased at "−Vcc" light at a lower brightness than the elements biased at "Vff−Vcc". As a result, uneven brightness is observed between these elements.

The Japanese Patent Application Unexamined Publication No. H09-232074 teaches the following driving method which overcomes this problem: A reset period is reserved at switching the cathode to be driven, and during the reset period, switches Sa1, Sa2, and Sc2, Sc3, Sc4–Scn are switched so that these switches are coupled to ground potential as shown in broken lines in FIG. 10. This discharges charges stored in each parasitic capacitance of respective non-lit elements. This reset period can equal respective charges stored in each parasitic capacitance of the elements just before the elements are driven. As a result, uneven brightness due to a difference between stored charges can be avoided.

This method, however, discharges the stored charges once out of every parasitic capacitance at switching the cathodes to be driven, and charges every parasitic capacitance again at driving the elements, thereby consuming a large amount of power. The charges stored by applying a reverse-bias-voltage, in particular, do not contribute at all to lighting the element, i.e. they just waste electric power.

This power consumption due to the reverse-bias-voltage is detailed hereinafter in a more specific way. In the display device shown in FIG. 10, let us assume the following case: where Parasitic capacitance of respective element: C (F)

Power supply voltage of reverse-bias-voltage: Vcc (V)

Frame frequency (a frequency for driving the cathodes in one cycle): Fv (Hz)

A static data is displayed on the display section, and a number of elements to be lit on a cathode "ca" ($1 \leqq a \leqq n$) is "$m_{on}$", then the number of elements to which the reverse-bias-voltage Vcc is applied is $(n-1)\times(m-m_{on})$, those elements are coupled to the cathodes except "ca" and coupled to anodes except the anodes of lit-elements.

Since those elements own parasitic capacitance "C" respectively, the energy "W" (J) supplied from the power supply to respective parasitic capacitances during the driving period of cathode "ca" is expressed as follows:

$$W=(1/2)\cdot C\cdot(Vcc^2)\cdot(n-1)\cdot(m-m_{on}) \quad (1)$$

The supplied energy "W" is discharged during the reset period, and charged by the power supply at the next scanning of the cathodes.

This control method discussed above can keep the non-selected elements at non-lit status. However, in an actual environment where this display device is used, external lights such as lamps and other light sources are also available. The elements reflect those external lights thereby producing reflection lights. The cathode lines are, in particular, formed of metal and thus produces a large amount of reflection lights. Under the strong external light such as sunlight, the difference between the illumination light and the reflection light becomes small, thereby lowering a contrast. As a result, pattern recognition of text data and the like becomes poor.

In order to overcome this disadvantage, a filter layer for limiting the external lights is often disposed on the surface of the display device. This measure decreases the influence of the external lights as well as increases an actual brightness responding to both of an attenuation factor in the filter layer and a desirable display brightness. A luminescent brightness of the conventional display device is determined with reference to a brightness visible enough even under intense external lights. Therefore, the display device illuminates with more brightness than it is required in a room or in the night where relatively weak external lights are available. The display thus becomes hard to see in a dark place, and consumes unnecessary power. This is a critical problem for display devices employed in battery-operated portable apparatuses among others.

As such, according to the conventional driving method, a power source for applying a reverse bias voltage supplies energy responsive to a number of non-lit elements at every scanning of cathodes. In this case a display pattern with a small number of lit-elements consumes a lot of power for charging/discharging each parasitic capacitance. This power basically does not contributes to lighting the elements, and just blocks the efforts of reducing power consumption.

SUMMARY OF THE INVENTION

The present invention addresses the problems discussed above, and aims to provide a driving method for reducing power consumption in a display device employing light-emitting elements as well as to provide the display device per se.

The driving method of the present invention is employed in the following display device: The display device having a plurality of light-emitting elements which include: (a) cathodes comprising a plurality of stripe lines, (b) anodes across the cathodes and comprising a plurality of stripe lines, and (c) a light-emitting layer between the cathodes and anodes.

The driving method comprises the steps below:

(1) First, illuminate a first light-emitting element coupled to a first cathode;

(2) Second, in order to illuminate a second light-emitting element coupled to a second cathode, run electric current into the second element. In this case, remove part of stored charges in the second element and leave charges in at least one light-emitting element other than the second element, then run electric current into the second element.

The display device of the present invention comprises the following elements:

(a) a plurality of light-emitting elements where the elements include:
  (a-1) cathodes comprising a plurality of stripe lines;
  (a-2) anodes across the cathodes and comprising a plurality of stripe lines; and
  (a-3) a light-emitting layer between the cathodes and anodes;

(b) an anode controller including:
  (b-1) current sources;
  (b-2) a first given potential point; and
  (b-3) a plurality of first switches for switching open/close between the anodes and the current sources/the first given potential point; and (c) a cathode controller including:
  (c-1) a voltage source;
  (c-2) a second given potential point; and
  (c-3) a plurality of second switches for switching open/close between the cathodes and the voltage source/the second given potential point.

The cathode controller applies a voltage to respective cathodes sequentially and the anode controller supplies a current to desirable anodes so that the light-emitting elements—where the cathodes receiving the voltage and the desirable anodes are across—are illuminated.

The display device is constructed in the following way: First, run electric current into a first light-emitting element coupled to a first cathode, thereby illuminating the first light-emitting element. Second, in order to illuminate a second light-emitting element coupled to a second cathode, run electric current into the second element. Before running the current into the second element, the first and second switches—both coupled to the second element—are closed to first and second given potential points respectively. At the same time, anodes coupled to the light-emitting elements other than the second element are opened to both of current sources and the first given potential point. This construction allows the display device to reduce the power consumption.

DETAILED DESCRIPTION OF THE INVENTION

Exemplary embodiments of the present invention are demonstrated hereinafter with reference to the accompanying drawings.

Exemplary Embodiment 1

Figure 2:
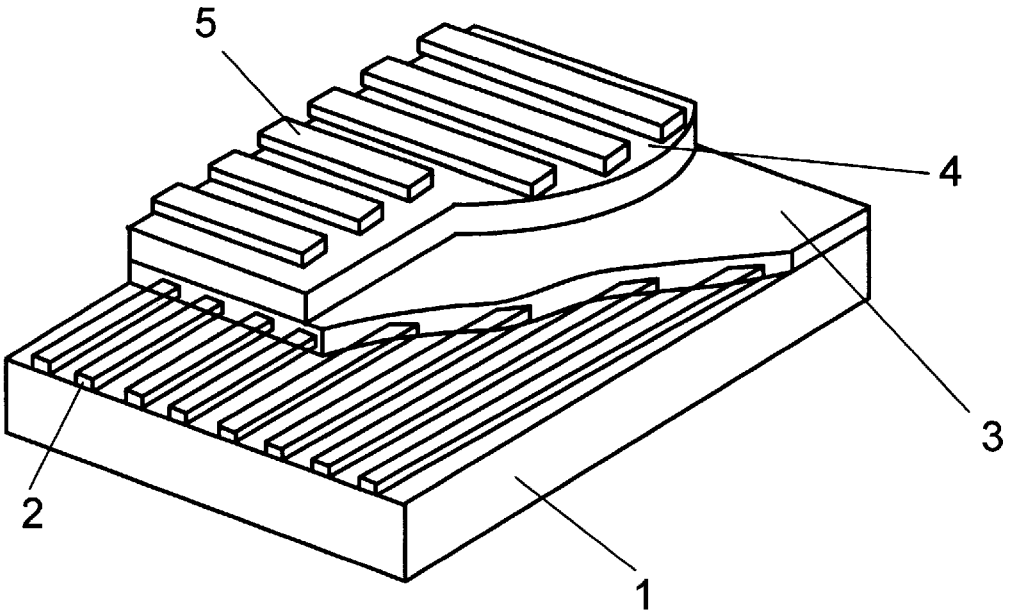
FIG. 2 is an enlarged partial perspective view of the display device shown in FIG. 1.
Figure 3:
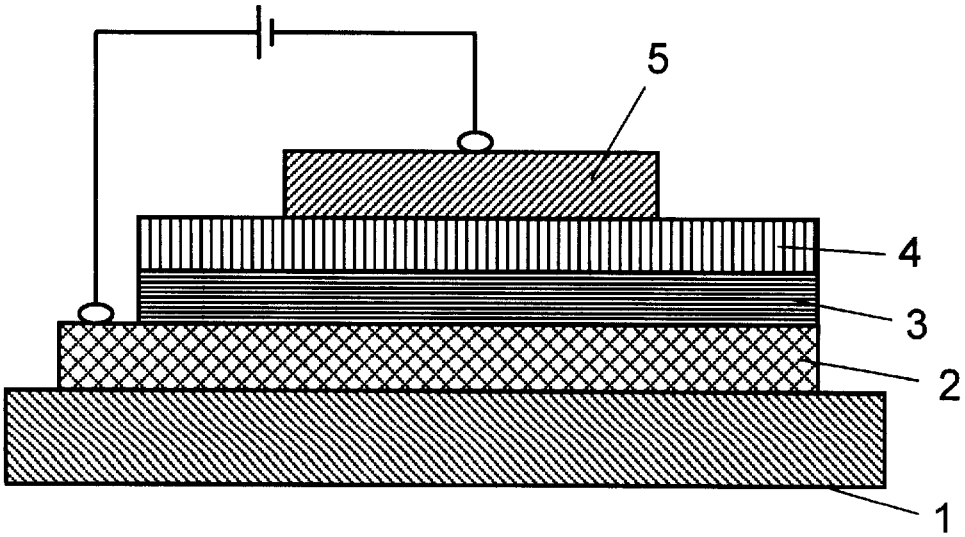
FIG. 3 is an enlarged partial view of the display device shown in FIG. 1.

FIG. 2 is an enlarged partial perspective view of a display device in accordance with the first exemplary embodiment of the present invention, and FIG. 3 is an enlarged partial view of the display device.

In FIGS. 2 and 3, a transparent glass or the like is used as substrate 1, on which anodes 2 comprising a plurality of stripe lines are formed. Hole transporting layer 3 is provided on substrate 1 or anodes 2. Light-emitting layer 4 is provided on hole transporting layer 3. Both layers 3 and 4 are made of organic materials. Cathodes 5 are formed on light-emitting layer 4, and cathodes 5 comprise a plurality of stripe lines crossing anodes 2 at approximate right angles. This construction forms organic EL elements, and light-emitting layer 4 sandwiched between anodes 2 and cathodes 5 is illuminated by running electric current between anode 2 and cathode 5.

Figure 1:
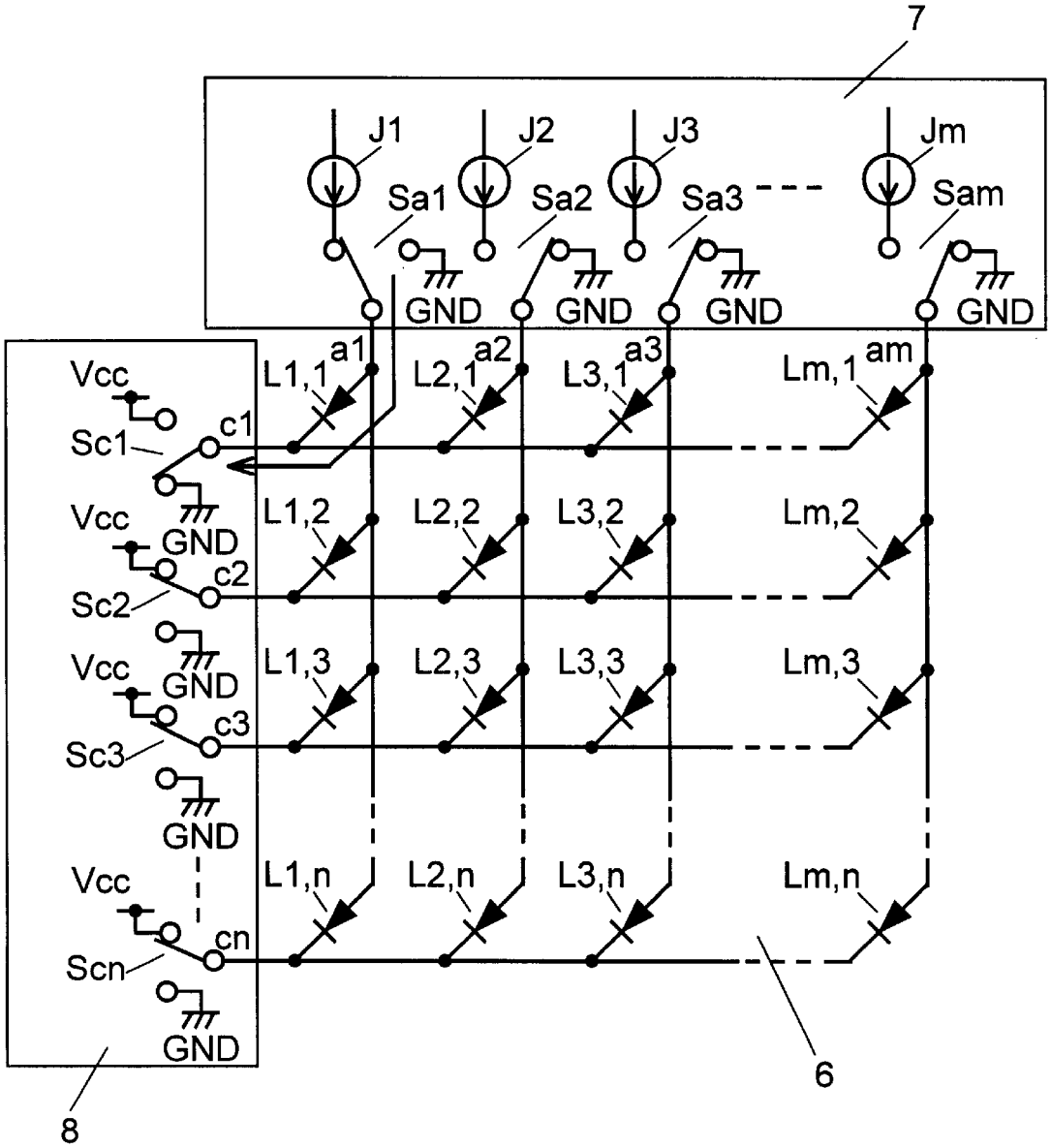
FIG. 1 illustrates a structure and a driving method of a display device in accordance with a first exemplary embodiment of the present invention.
Figure 4:
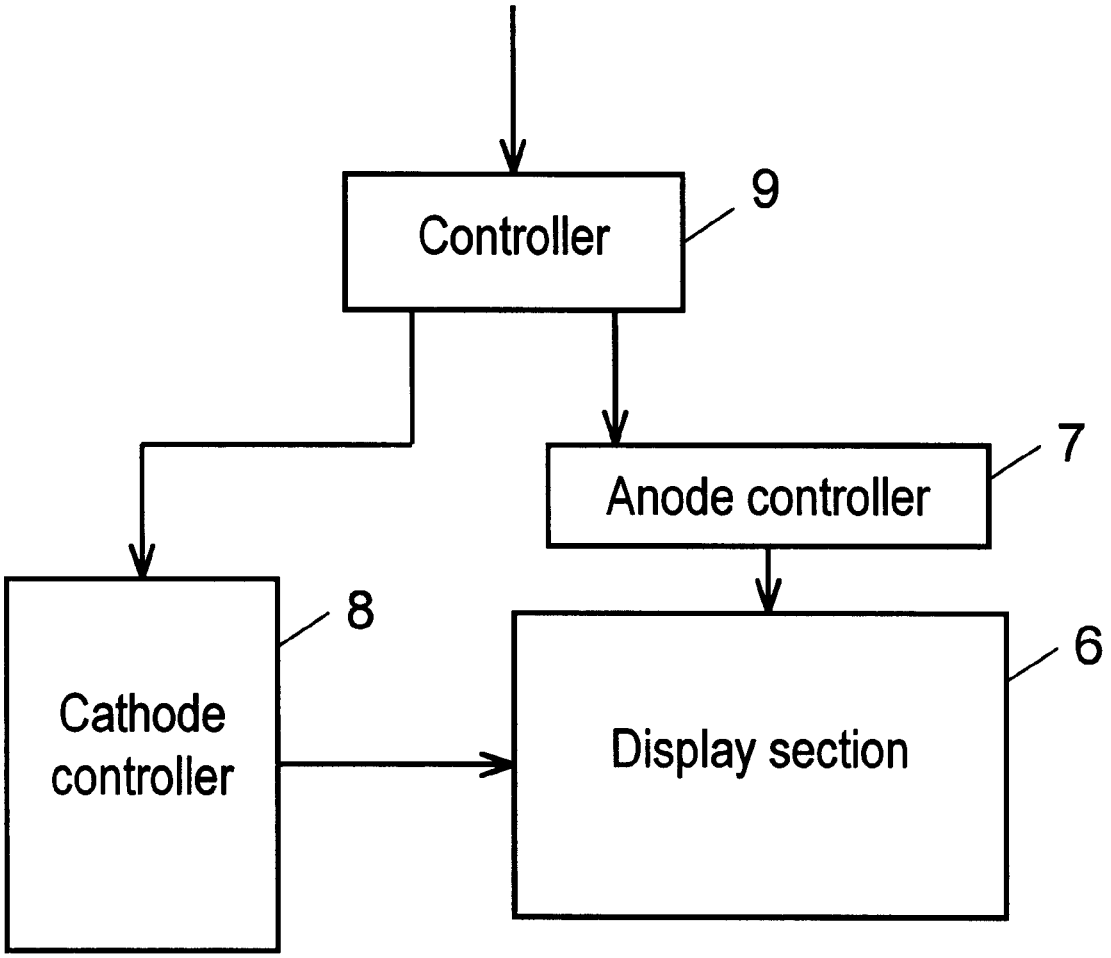
FIG. 4 is a block diagram of the display device shown in FIG. 1.

FIG. 1 illustrates a structure of the display device in accordance with the first exemplary embodiment of the present invention, and FIG. 4 is a block diagram of the same display device.

In FIGS. 1 and 4, display section 6 employs organic EL elements shown in FIGS. 2 and 3. Display section 6 is coupled to cathode controller 8 controlling cathodes 5 and anode controller 7 controlling anodes 2. Controller 9—formed of a CPU or the like—receives an external signal and supplies control signals to anode controller 7 and cathode controller 8.

An operation of the display device constructed above is demonstrated hereinafter.

First, when controller 9 receives an external signal from a keyboard or the like, controller 9 determines whether display section 6 is displayed or not based on the signal. Second, controller 9 sends signals of displaying text data or characters on display section 6 to cathode controller 8 and anode controller 7. As shown in FIG. 1, a plurality of switches are provided to respective controllers 7 and 8 in a manner of one switch for each stripe line.

Cathode controller 8 scans the plurality of stripe lines making up cathodes 5 sequentially. Anode controller 7 supplies current to anodes 2 of the elements to be illuminated—located at the place on the light-emitting layer. Specified organic EL elements (light-emitting elements) of light-emitting layer 4 are thus illuminated, thereby displaying desirable text data and the like.

A driving method and a resulting power-saving-effect are detailed with reference to FIGS. 1, 5 and 6.

FIG. 1 illustrates a construction of the display device where m×n pcs of organic EL elements are arrayed, and also illustrates a method of driving for illuminating element L1,1. FIG. 5 illustrates a method of discharging each parasitic capacitance in the same display device, and FIG. 6 illustrates storing status of charges at each parasitic capacitance also in the same display device.

In this embodiment, element L1,1 is illuminated in the first place, then elements L1,2 and L2,2 are illuminated as an example. A series of operation of these elements is demonstrated hereinafter.

In FIG. 1, switch Sa1 couples anode line a1 to current source J1, and switches "Sa2–Sam" couple anode lines "a2–am" to ground potential (GND). Switch Sc1 couples cathode line cl to ground potential (GND). Switch "Sc2–Scn" couple cathode lines "c2–cn" to voltage source Vcc. At this moment, a reverse bias voltage is applied to the elements placed at the intersections of anode lines "a2–am" and cathode lines "c2–cn", thereby storing charges. Using a parasitic capacitance C of an element and charges Q stored by a reverse bias voltage, an equation of "Q per element= C·Vcc" is established.

Figure 5:
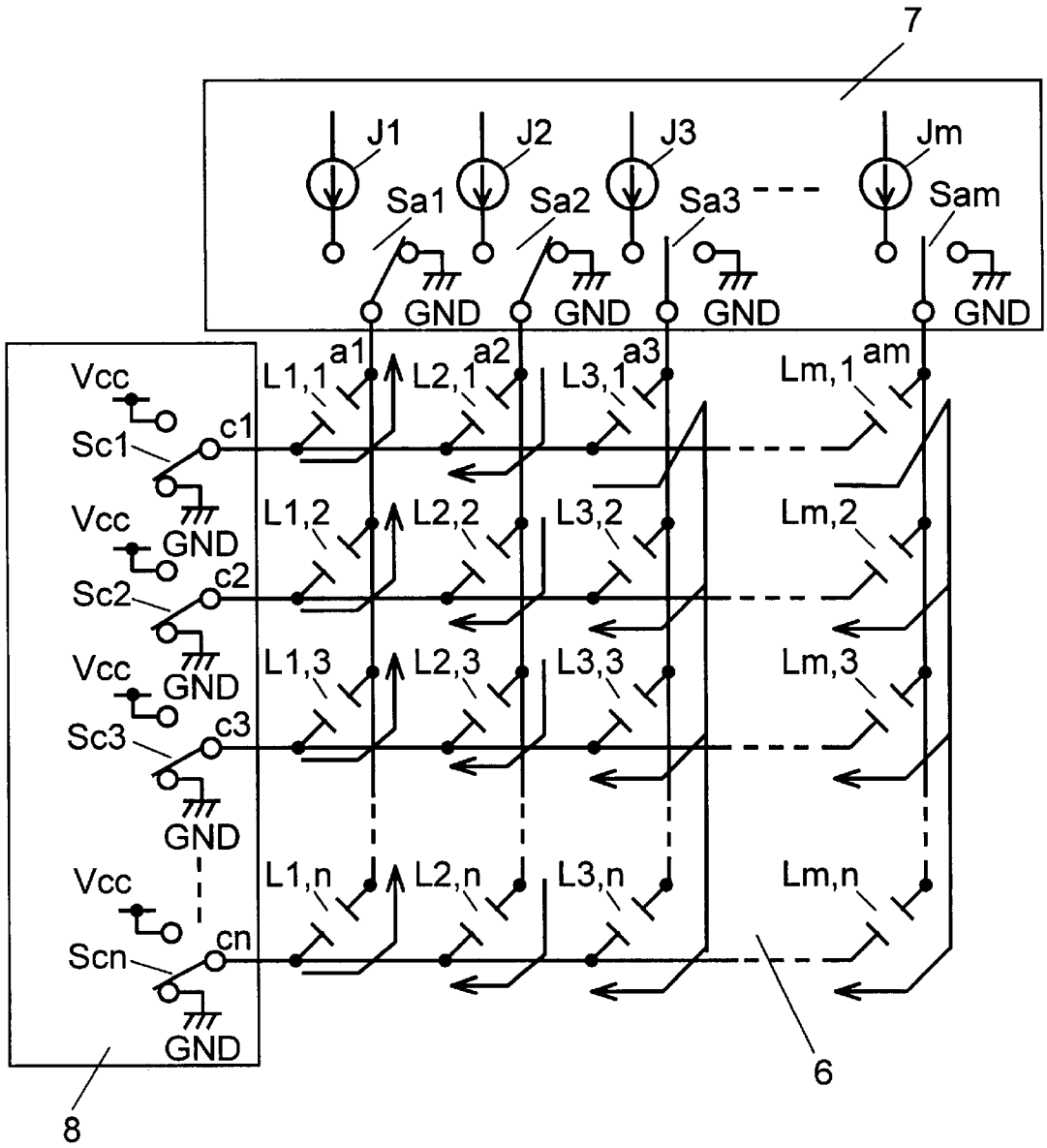
FIG. 5 illustrates a method of discharging each parasitic capacitance in the same display device.

Next, before elements L1,2 and L2,2 are lit, couplings shown in FIG. 5 are prepared, i.e. switches Sa1 and Sa2 couple anode lines a1 and a2 to ground potential (GND) respectively, while switches "Sa3–Sam" are open. Switches "Sc1–Scn" couple cathode lines "c1–cn" to ground potential (GND).

These couplings result in the following operations (i), (ii) and (iii).

(i) At lighting element L1,1, charges stored therein are discharged by applying a forward bias voltage.

(ii) Among the elements which store charges by applying a reverse bias voltage, elements "L2,2–L2,n" discharge the stored charges.

(iii) In elements L3,1–L3,n on anode a3, part of charges stored in elements L3,2–L3,n move to L3, 1. This changes the amount of charges in elements L3,1–L3,n to {(n−1)/n}·Q. In the same manner, elements on anodes "a4–am" undergo the movement of charges, and as a result, respective amounts of charges in every element on the anodes change to {(n−1)/n}·Q, as shown in FIG. 6.

Figure 7:
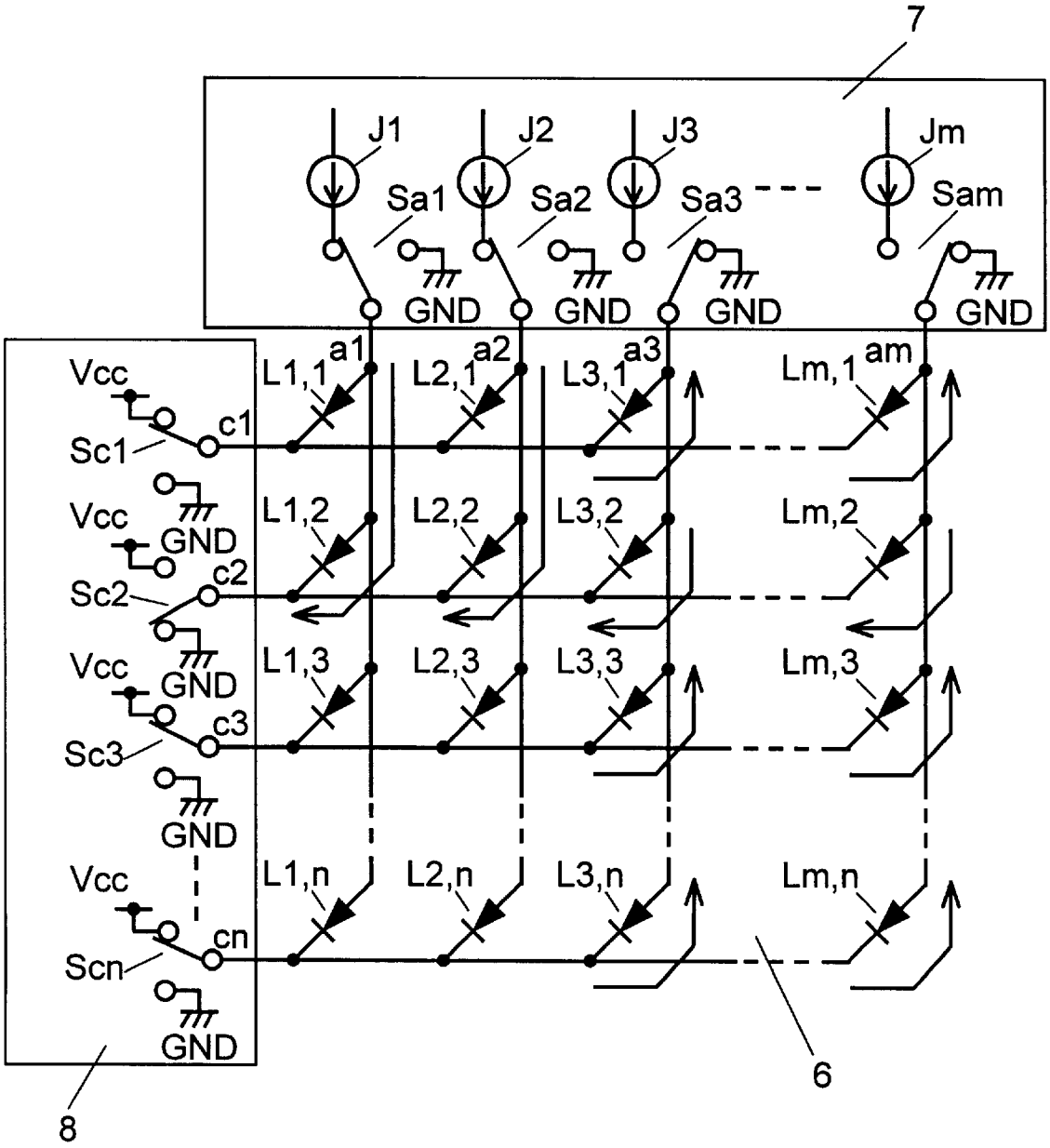
FIG. 7 is a method of driving and lighting another element in the same display device.

Then elements L1,2 and L2,2 are lit and driven as shown in FIG. 7, i.e. switches Sa1 and Sa2 couple anode lines a1 and a2 to current sources J1 and J2 respectively. Switches Sa3–Sam couple anode lines a3–am to ground potential (GND). Switch Sc2 couples cathode line c2 to ground potential (GND). Switches Sc1, Sc3–Scn couple cathode lines c1, c3–cn to voltage source Vcc.

Figure 6:
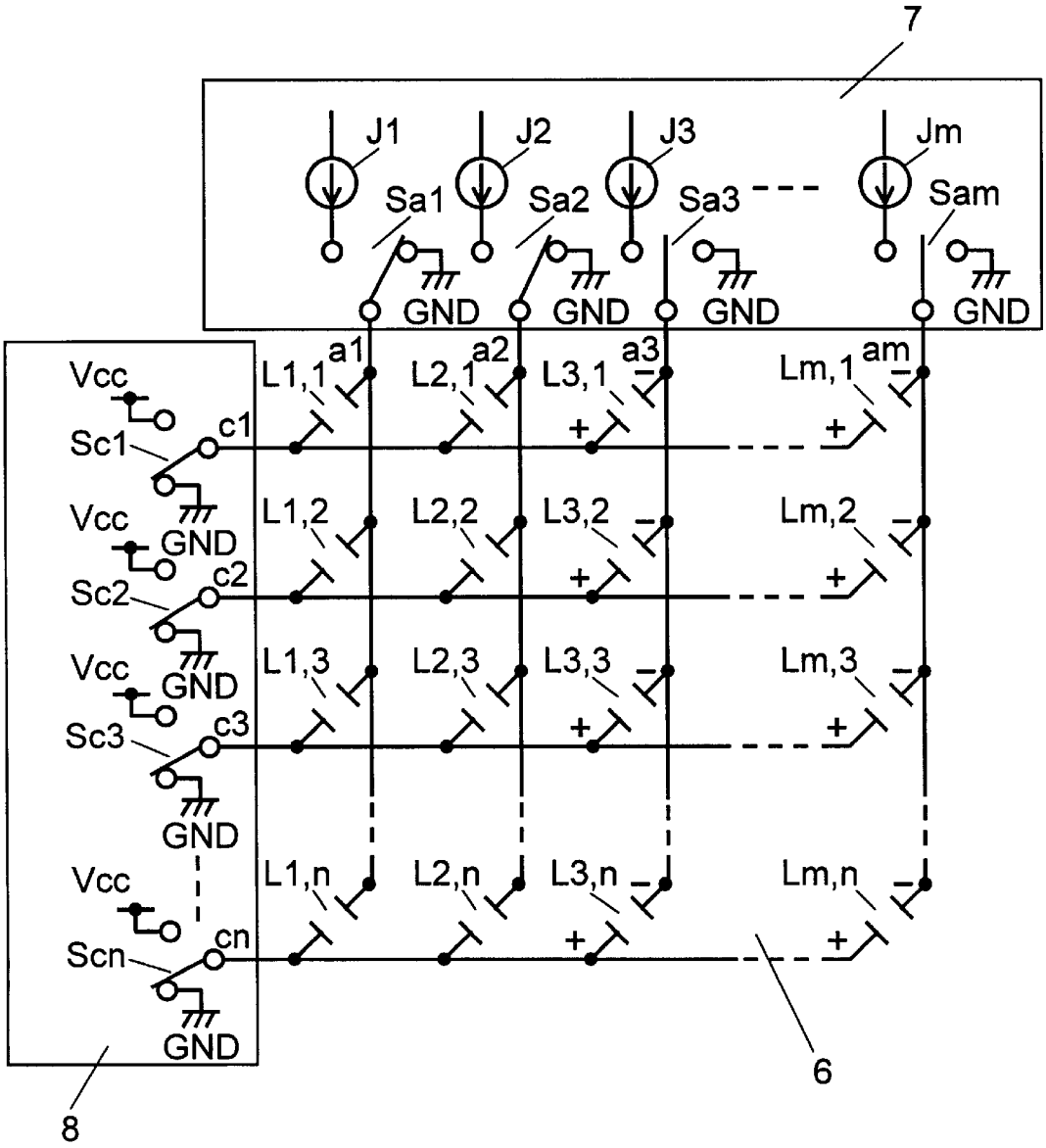
FIG. 6 illustrates storing status of charges at each parasitic capacitance in the same display device.

At this time, since elements L1,1–L1,n and L2,1–L2,n have discharged the stored charges as shown in FIG. 6, no difference is found in stored charges due to the difference in biased status just before the lighting. As a result, no difference is observed in brightness between elements L1,2 and L2,2.

Regarding the charging/discharging of charges, elements L3,2–Lm,2 have the same potential at their anodes and cathodes, thus they discharge the stored charges amounted to {(n−1)/n}·Q. Elements L3,1–Lm,1, L3,3–Lm,3, L3,4–Lm,4 . . . , L3,n–Lm,n receive reverse-bias-voltages, and thus they charge themselves with charges by the amount of (1/n)·Q, which results in storing the charge amount Q respectively.

At this time, static energy WP newly stored in one element is calculated as follows:

Voltage V0 of elements L3,1–Lm,1, L3,3–Lm,3, L3,4–Lm,4, . . . L3,n–Lm,n just before elements L1,2 and L2,2 are driven is expressed in the following equation:

$$\mathbf{V0}=[\{(n-1)/n\}\cdot Q]/C=\{(n-1)/n\}\cdot Vcc$$

Static energy WP is thus expressed in the following equation:

$$\begin{aligned} WP&=(½)\cdot C\cdot(Vcc^2)-(½)\cdot C\cdot \mathbf{V0}^2\\ &=(½)\cdot C\cdot(Vcc^2)-(½)\cdot C\cdot[\{(n-1)/n\}\cdot Vcc]^2\\ &=(½)\cdot C\cdot(Vcc^2)\cdot(2n-1)/(n^2) \end{aligned} \tag{2}$$

The number of elements L3,1–Lm,1, L3,3–Lm,3, L3,4–Lm,4, . . . L3,n–Lm,n is (m−2)·(n−1). Total energy "W" stored in each parasitic capacitance by applying a reverse biased voltage is thus expressed in the following equation:

$$W=(m-2)\cdot(n-1)\cdot(½)\cdot C\cdot(Vcc^2)\cdot(2n-1)/(n^2) \tag{3}$$

On the other hand, a conventional driving method requires energy W' which is expressed in the following equation:

$$\begin{aligned} W&=(½)\cdot C\cdot(Vcc^2)\cdot(n-1)\cdot(m-2)\\ &=(m-2)\cdot(n-1)\cdot(½)\cdot C\cdot Vcc^2 \end{aligned} \tag{4}$$

According to the equations (3) and (4), energy W required in this first exemplary embodiment is thus expressed in W'·(2n−1)/($n^2$).

As discussed above, this first embodiment of the present invention can reduce the static energy for charging the parasitic capacitance. Further, the amounts of charges moving between the power source and the display section per unit time are reduced. This contributes to lower the power consumption due to resisting component on the circuit such as resistors and the like.

In this embodiment, parts of elements are lit as an example, and other elements can be handled in the same manner. More complicated display pattern can be also lit with less energy than the conventional driving method.

The discharging is controlled so that an amount of charges which does not influence the brightness of the lit-elements is left in the parasitic capacitance by considering parasitic capacitance and a number of elements. This control can be realized by, e.g. adjusting a discharging time. Such a control can further reduce the power consumption.

In this embodiment, each electrode is coupled to ground potential; however, each electrode can be coupled to a point having a given potential instead of the ground potential.

Exemplary Embodiment 2

Figure 8:
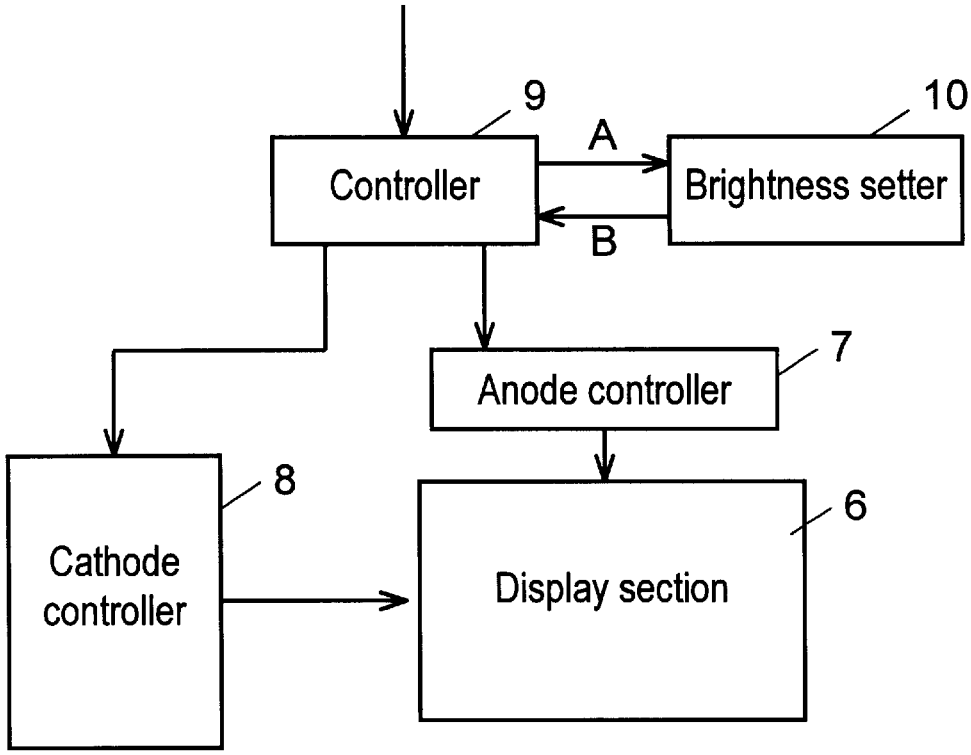
FIG. 8 is a block diagram of a display device in accordance with a second exemplary embodiment of the present invention.

FIG. 8 is a block diagram of a display device in accordance with the second exemplary embodiment of the present invention.

In FIG. 8, display section 6, anode controller 7, cathode controller 8 and controller 9 are the same as those used in the first embodiment and shown in FIG. 4.

The second embodiment differs from the first one in newly providing brightness setter 10, which determines a brightness level of light-emitting elements based on external information.

Brightness setter 10 determines a brightness level based on information from outside such as signals sent from at least one of another circuit, member and sensor. The brightness level determined by setter 10 is fed into controller 9, which then outputs control signals to anode controller 7 and cathode controller 8.

Based on the brightness level, anode controller 7 varies the ON time or ON cycle between at least one of switches Sa1–Sam and at least one of current sources J1–Jm, thereby adjusting a brightness of light-emitting elements.

A first example of brightness setter 10 employs a photo-sensor coupled thereto. In this case, the photo-sensor detects a degree of the light in the environment, where an electronic apparatus employing the display device, works. Based on the signals from the sensor, setter 10 determines a brightness level. This construction allows controller 9 to adjust a brightness of the light-emitting elements so that a video displayed on the display device can be easy to see as well as unnecessary high illumination can be suppressed. As a result, power consumption in the display device can be reduced.

Controller 9 sends control signals sequentially or step by step to anode controller 7 responsive to the brightness level, thereby adjusting the brightness level. When controller 9 sends the control signals in series, the brightness of the light-emitting elements are controlled every time so that the display always presents a video easy to see. In addition, power consumption can be reduced.

Illuminating brightness can be adjusted step by step responsive to brightness levels so that the load on controller 9 can be lightened. For instance, three brightness ranges are prepared responsive to levels of the brightness, i.e. when a brightness level detected by the sensor is within a first range, the display is adjusted to present the highest brightness. When the brightness level is in the second range, the display is adjusted to present the lowest brightness, and when in the third range, the display shows a medium brightness. This arrangement allows controller 9 to send control signals having some width, thereby simplifying the control as well as alleviating the load on controller 9.

Three ranges are prepared in this second embodiment; however, two ranges or more than three ranges can also work. The control signals are produced by controller 9 in this embodiment; however, brightness setter 10 can produce them for controller 9. This further lightens the load on controller 9.

A second example of brightness setter 10 utilizes external information sent from a calendar or a clock provided in the electronic apparatus to which the display device is mounted, thereby adjusting a brightness responsive to a date or a time.

To be more specific, brightness setter 10 determines a brightness level responsive to a signal sent from the calendar or clock, and sends the set level to controller 9, thereby adjusting a brightness of light-emitting elements. For instance, day and night are distinguished by time so that an illuminating brightness is adjusted in two ways, i.e. a day mode and a night mode. This method can eliminate the photo-sensor, thereby reducing a number of components and downsizing the electronic apparatus. When a calendar and a clock are combined, day and night are more correctly distinguished responsive to seasons although day time and night time vary depending on seasons. As a result, the brightness can be more accurately adjusted.

Sensors such as a photo-sensor can be combined with the clock or calendar so that the brightness can be adjusted more correctly. In this case, signals from the photo-sensor are given priority to the information from the clock or calendar so that the display device at a well-lighted room in the evening can present a high brightness for better viewing.

A third example of brightness setter 10 uses an input device such as a keyboard (not shown) employed in the electronic apparatus to which the display device is mounted. Through the keyboard, external information is input to brightness setter 10. Since an optimal brightness depends on an individual person, a user can adjust the brightness to his/her optimal rightness with the keyboard.

An easy-to-see display with a low power consumption can be achieved by employing at least one of the three examples discussed above. When employing the third example, at least one of the first or second example is preferably combined.

An operation of the display device constructed above and employing a photo-sensor is demonstrated hereinafter.

In FIG. 8, signals are firstly fed into controller 9 from outside such as the keyboard or the like. Controller 9 determines whether display section 6 is to be displayed or not based on the signals, then supplies signals of displaying text data or characters on display section 6 to cathode controller 8 and anode controller 7. A plurality of switches are provided to controllers 7 and 8 respectively, and each switch is provided to respective stripe lines.

Cathode controller 8 scans sequentially the plurality of stripe lines assigned to the cathodes. Anode controller 7 controls electric current so that the current runs through desirable anodes of an element, disposed on a light-emitting layer, to be illuminated. Display section 6 thus displays desirable text data on its screen.

Controller 9 outputs instruction signal A to brightness setter 10, and signal A prompts a light detector (photo-sensor) of setter 10 to detect the illumination around the apparatus, then brightness setter 10 outputs brightness level B to controller 9. Based on brightness level B, controller 9 controls anode controller 7 and cathode controller 8 such that the luminescent brightness of elements is lowered when the illumination is low thereby reducing power consumption, and the luminescent brightness is raised when the illumination is high thereby improving visibility. Brightness adjustment can be achieved by e.g. varying a pulse width of the current running through desirable anodes, namely varying a period during which the current runs.

Figure 9:
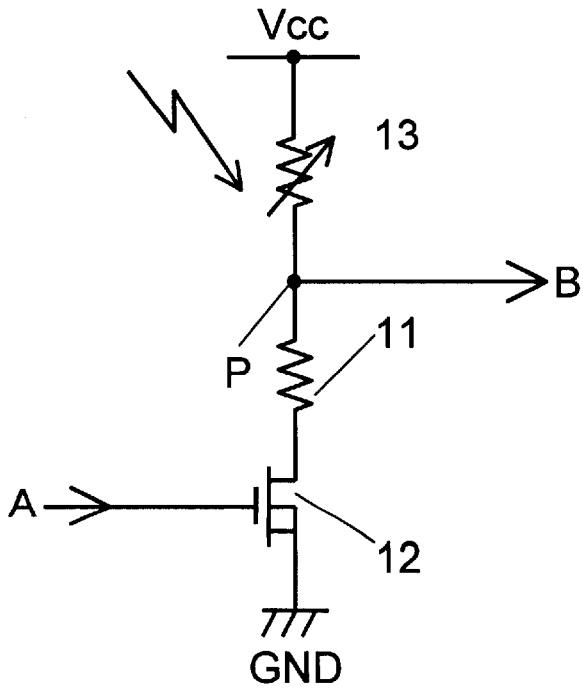
FIG. 9 is a circuit diagram of a photo-sensor employed in the display device shown in FIG. 8.
Figure 10:
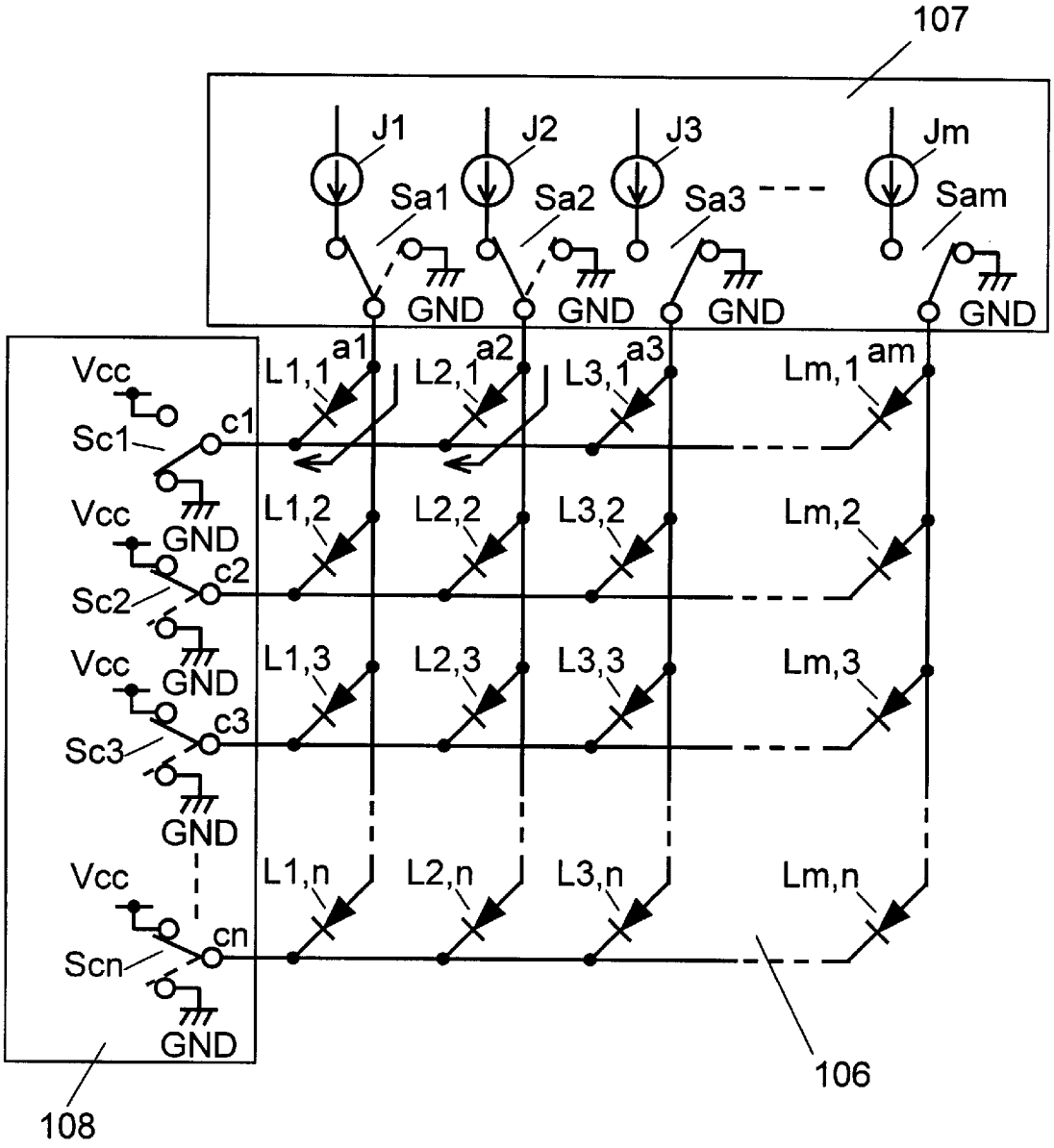
FIG. 10 PRIOR ART
FIG. 10 illustrates a conventional driving method of a display device and a conventional discharging method of each parasitic capacitance.

FIG. 9 illustrates a construction of the light detector discussed above.

In FIG. 9, visible photo-conductive element 13 has a characteristic that when it receives light, the resistor value thereof lowers responsive to the illumination. Visible photo-conductive element 13, resistor 11 and switching element 12 form a series circuit, which is coupled between power-supply-terminal Vcc and ground terminal GND. Instruction signal A from controller 9 prompts switching element 12 to be ON status, then current runs through element 13 and resistor 11. A resistor value of element 13 varies depending on illumination, thus a change of illumination can be monitored as a voltage change at coupling point P of element 13 and resistor 11. In other words, environmental light can be measured as brightness level B by measuring the potential at point P.

The combination of the first and second embodiments results in more positive low power consumption.

The present invention as discussed above can suppress dispersion of brightness due to parasitic capacitance of the organic EL element as well as realize low power consumption.

Based on information supplied from other sources discussed in the previous examples, the current running through the organic EL element is controlled so that the brightness can be adjusted. This improves the visibility of the display and also reduces power consumption.

In the embodiments discussed above, the organic EL element is used as the light-emitting element; however, an inorganic EL element can also produce the same effect.

What is claimed is:

1. A method of driving a display device, said method comprising the steps of:

(a) providing the display device, wherein said display device includes a plurality of cathodes, anodes facing the cathodes, and a plurality of emitting elements having an organic emitting layer disposed between the cathodes and the anodes;

(b) applying a direct current to the organic emitting layer;

(c) illuminating a first light-emitting element coupled to a first cathode;

(d) removing electric charges stored in a second light-emitting element and leaving electric charges in at least one of the light-emitting elements except the second light-emitting element; and (e) running electric current through the second light-emitting element.

2. A method of driving a display device, said method comprising the steps of:

(a) providing the display device, wherein said display device includes a plurality of light-emitting elements which include cathodes including a plurality of stripe lines, anodes across the cathodes and having a plurality of strip lines, and a light-emitting layer between the cathodes and the anodes;

(b) detecting light in an environment where the display device is used; and (c) controlling electric current running through the light-emitting layer responsive to the light detected.

3. The method of driving a display device as defined in claim 2 wherein the electric current running through the light-emitting layer is controlled by varying a period during which the current runs.

4. A method of driving a display device, said method comprising the steps of:

(a) providing the display device, wherein said display device includes a plurality of cathodes, anodes facing the cathodes, and a plurality of emitting elements having an organic emitting layer disposed between the cathodes and the anodes;

(b) applying a direct current to the organic emitting layer;

(c) setting a luminance level responsive to a time signal sent from a clock; and (d) controlling a current running through the emitting layer responsive to the luminance level.

5. The method of driving a display device as defined in claim 4 wherein the electric current running through the light-emitting layer is controlled by varying a period during which the current runs.

6. A display device comprising:

(a) a plurality of light-emitting elements including:

cathodes comprising a plurality of stripe lines;

anodes across said cathodes and comprising a plurality of stripe lines; and a light-emitting layer provided between said cathodes and said anodes, (b) an anode controller including:

electric current sources;

a first point having a given potential; and a plurality of first switches for opening and closing between said anodes and one of said electric current sources and said first point; and (c) a cathode controller including:

a voltage source;

a second point having a given potential; and a plurality of second switches for opening and closing between said cathodes and one of said voltage source and said second point, wherein said cathode controller applies a voltage to said cathodes sequentially as well as said anode controller supplies electric current to desirable said anodes for illuminating said light-emitting elements at intersections of said cathodes receiving a voltage and said desirable anodes, wherein said display device illuminates a first light-emitting element coupled to a first cathode by running electric current through said first element, and for illuminating a second light-emitting element coupled to a second cathode, said first and said second switches—both coupled to the second element—are closed to said first and said second points respectively, and at the same time, anodes coupled to said light-emitting elements other than the second element are opened to both of said current sources and said first point, before electric current runs into said second element.

7. A display device comprising:

(a) a plurality of light-emitting elements including:

cathodes comprising a plurality of stripe lines;

anodes across said cathodes and comprising a plurality of stripe lines; and a light-emitting layer provided between said cathodes and said anodes, (b) an anode controller including:

electric current sources;

a first point having a given potential; and a plurality of first switches for opening and closing between said anodes and one of said electric current sources and said first point;

(c) a cathode controller including:

a voltage source;

a second point having a given potential; and a plurality of second switches for opening and closing between said cathodes and one of said voltage source and said second point, (d) a brightness setter for determining a brightness level of said light-emitting elements based on external information; and (e) a controller for controlling electric current running through said light-emitting elements based on the determined brightness level, wherein said cathode controller applies a voltage to said cathodes sequentially as well as said anode controller supplies electric current to desirable said anodes for illuminating said light-emitting elements at intersections of said cathodes receiving a voltage and said desirable anodes, and wherein, based on the determined brightness level, said controller controls said anode controller for adjusting electric current running through said light-emitting elements.

8. The display device as defined in claim 7 wherein the external information is sent from a photo-sensor.

9. The display device as defined in claim 7 wherein the external information is sent from at least one of a clock and a calendar.

10. The display device as defined in claim 7 further comprising an input section through which desirable information is supplied, wherein the brightness level of the light-emitting elements is determined based on the information.

11. A display device comprising:

(a) a plurality of emitting elements including:

(a-1) a plurality of cathodes;

(a-2) anodes facing said cathodes;

(a-3) an emitting layer disposed between said cathodes and said anodes;

(b) a current source for supplying an electric current to selected members of said emitting elements;

(c) a luminance setter for setting a luminance level of said emitting elements based on external information; and (d) a controller for controlling a current running through said emitting elements.

12. The display device as defined in claim 11, wherein the external information is from an optical sensor.

13. The display device as defined in claim 11, wherein the external information is from at least one of a clock and a calendar.

14. The display device as defined in claim 11 further comprising an input section for receiving desirable information input by a user, so that the luminance level of said emitting elements is set based on the desirable information.

* * * * *

UNITED STATES PATENT AND TRADEMARK OFFICE

CERTIFICATE OF CORRECTION

PATENT NO. : 6,222,323 B1
DATED : April 24, 2001
INVENTOR(S) : Yamashita et al.

It is certified that error appears in the above-identified patent and that said Letters Patent is hereby corrected as shown below:

Column 9,
Line 39, “strip” should read -- stripe --.

Signed and Sealed this

Twenty-first Day of January, 2003

JAMES E. ROGAN
*Director of the United States Patent and Trademark Office*